US008648540B1

(12) United States Patent
Zhang

(10) Patent No.: US 8,648,540 B1
(45) Date of Patent: Feb. 11, 2014

(54) DECORATION LAMP FOR PRODUCING MATCHED SOUND AND ILLUMINATION EFFECTS

(75) Inventor: Cheng-Chun Zhang, Kaohsiung (TW)

(73) Assignee: Gemmy Industries Corporation, Coppell, TX (US)

( * ) Notice: Subject to any disclaimer, the term of this patent is extended or adjusted under 35 U.S.C. 154(b) by 0 days.

(21) Appl. No.: 13/598,120

(22) Filed: Aug. 29, 2012

(51) Int. Cl.

| | |
|---|---|
| ***F21S 4/00*** | (2006.01) |
| ***H05B 37/00*** | (2006.01) |
| ***H05B 39/00*** | (2006.01) |
| ***H05B 41/00*** | (2006.01) |

(52) U.S. Cl.
USPC ..... 315/185 S; 315/185 R; 315/192; 315/297

(58) Field of Classification Search
None
See application file for complete search history.

(56) References Cited

U.S. PATENT DOCUMENTS

| | | | | |
|---|---|---|---|---|
| 5,555,163 | A * | 9/1996 | Pisani | 362/244 |
| 7,202,607 | B2 * | 4/2007 | Kazar et al. | 315/185 S |
| 2005/0073265 | A1 * | 4/2005 | Wang | 315/185 S |
| 2010/0135022 | A1 * | 6/2010 | Deguara | 362/249.06 |

* cited by examiner

*Primary Examiner* — Anh Tran
(74) *Attorney, Agent, or Firm* — Ming Chow; Sinorica, LLC

(57) ABSTRACT

A decoration lamp with a speaker for correspondingly illuminating and speaking has a decoration body, multiple fixtures, multiple illumination units, a translucent cover, a speaker and a control device. The fixtures are mounted on the decoration body. The illumination units are mounted in the fixtures. The translucent cover is mounted on the decoration body to cover the illumination units. The control device sequentially activates the illumination units for changing the patterns and activates the speaker making voices for the patterns. The patterns and the voices change synchronously.

17 Claims, 20 Drawing Sheets

DECORATION LAMP FOR PRODUCING MATCHED SOUND AND ILLUMINATION EFFECTS

BACKGROUND OF THE INVENTION

1. Field of the Invention

The present invention relates to a decoration lamp, and more particularly to a decoration lamp for producing matched sound and illumination effects.

2. Description of Related Art

In order to decorate the amusement places for delightful atmosphere, the places may be decorated with figurines and posters. For example, a pumpkin figurine is common at Halloween parties. The pumpkin figurine substantially has a figurine body and a lamp.

The figurine body can be carved with a face pattern. The lamp is hung in the figurine body. A user can decorate the party place with the pumpkin figurines. At night, the lamp is lighted up to shine the pattern of the figurine body outward to create the Halloween atmosphere.

The conventional pumpkin figurine has a simple structure and is a static decoration figurine. Nowadays a pumpkin figurine displays only one pattern at a time. Therefore, the pumpkin figurine is boring with very little variation. The conventional pumpkin figurine does not effectively attract the viewer's attention.

SUMMARY OF THE INVENTION

An objective of the present invention is to provide a decoration lamp for producing matched sound and illumination effects. The decoration lamp can be lighted up to display multiple patterns and make corresponding voices at a same time. The attraction of the decoration lamp of the present invention gets enhanced.

The decoration lamp of the present invention comprises a decoration body, multiple fixtures, multiple illumination units, a translucent cover, a speaker and a control device.

The decoration body has a front surface and a back surface.

The fixtures are mounted on the decoration body and respectively have a first connector and a second connector. The first connector is mounted on the front surface of the decoration body and has an opening. The second connector is mounted on the back surface of the decoration body and engages with the first connector.

The illumination units are respectively mounted in the fixtures and are exposed in the openings of the first connectors.

The translucent cover is mounted on the front surface of the decoration body to cover the illumination units.

The speaker makes different voices according to different sound signals.

The control device stores the sound signals, is electrically connected to the illumination units and the speaker, and sequentially executes multiple modes. Each mode is applied to activate a part of the illumination units to show a certain pattern through the translucent cover and to output one of the voices corresponding to the certain pattern by the speaker.

A user can use a flexible fabric as the decoration body and defines multiple patterns on the decoration body. The control device has sound signals respectively corresponding to the patterns. When the control device is not at work, viewers only see the surface of the translucent cover and cannot see the illumination units behind the translucent cover. When the control device is activated, the control device sequentially activates the part of the illumination units for changing the patterns and activates the speaker to make corresponding voices for the patterns, so that viewers can see the light patterns on the translucent cover. The decoration lamp of the present invention has both visual and acoustic effects. Therefore, the decoration lamp of the present invention is more interesting, lively and attractive than the conventional one.

DETAILED DESCRIPTION OF THE PREFERRED EMBODIMENT

Figure 1:
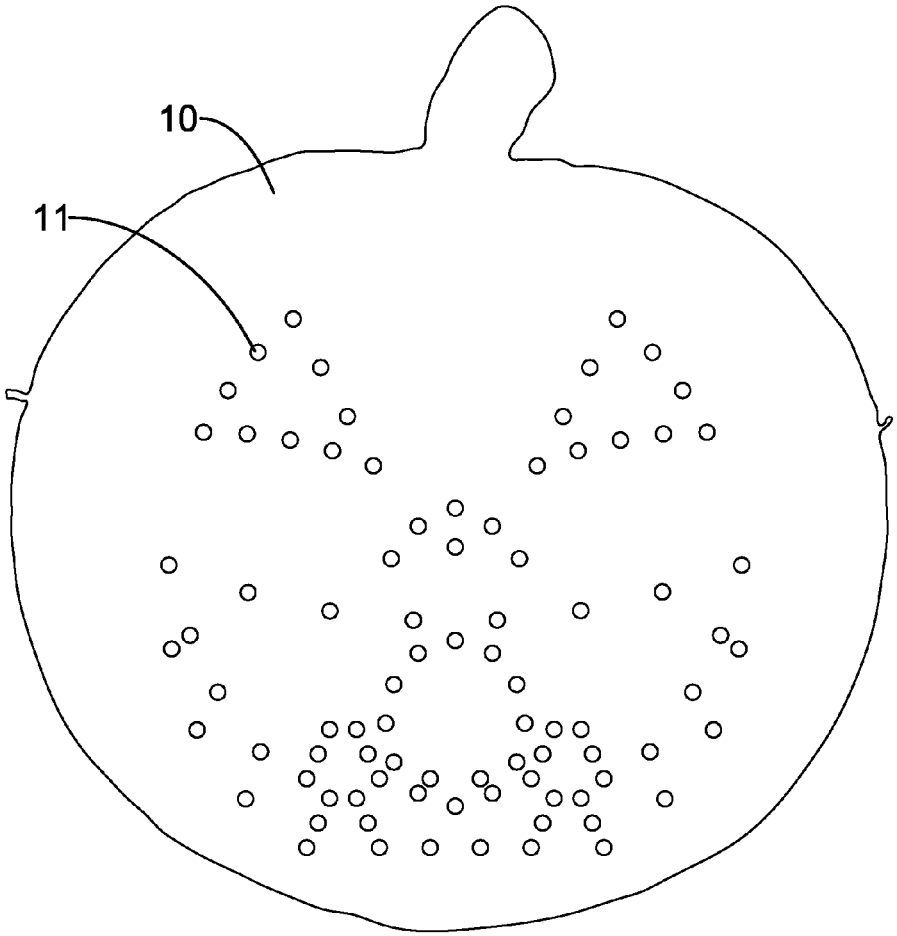
FIG. 1 is a plan view of the decoration body of the present invention.
Figure 2:
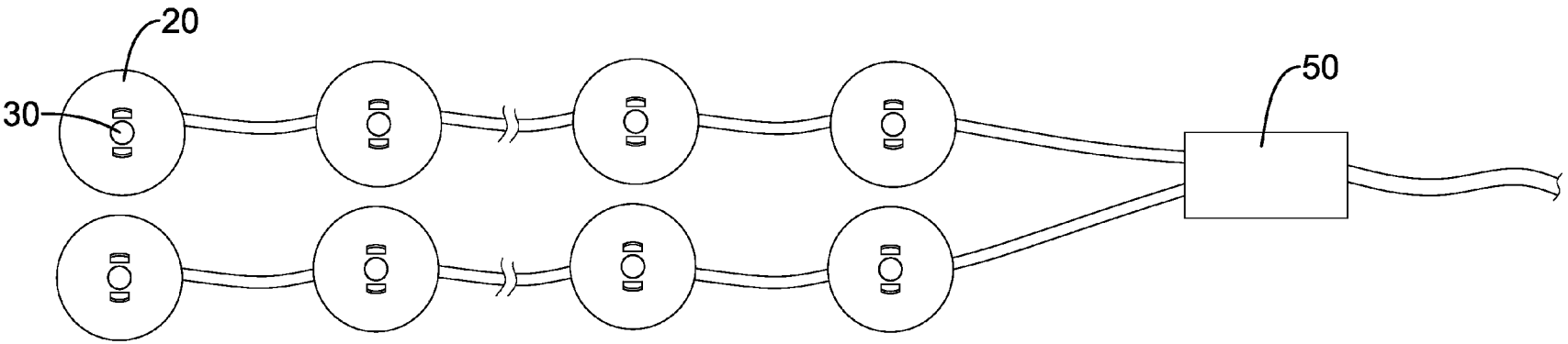
FIG. 2 is a plan view of the fixtures, the illumination units and the control device of the present invention.

With reference to FIGS. 1-3, a decoration lamp of the present invention comprises a decoration body 10, multiple fixtures 20, multiple illumination units 30, a translucent cover 100, a speaker 40 and a control device 50.

The decoration body 10 can be a flexible fabric, cloth or a figurine. The decoration body 10 has a front surface, a back surface and multiple holes 11. The front surface is a demonstration surface for defining patterns. The holes 11 are formed on the outlines of the patterns and formed through the front surface and the back surface of the decoration body 10. With reference to FIG. 1, the decoration body 10 of an embodiment of the present invention is a pumpkin figurine. With reference to FIGS. 4A-4F, the holes 11 in FIG. 1 form multiple face patterns.

The fixtures 20 are securely mounted through the holes 11 of the decoration body 10. Each fixture 20 has a first connector 21 and a second connector 22.

Figure 5:
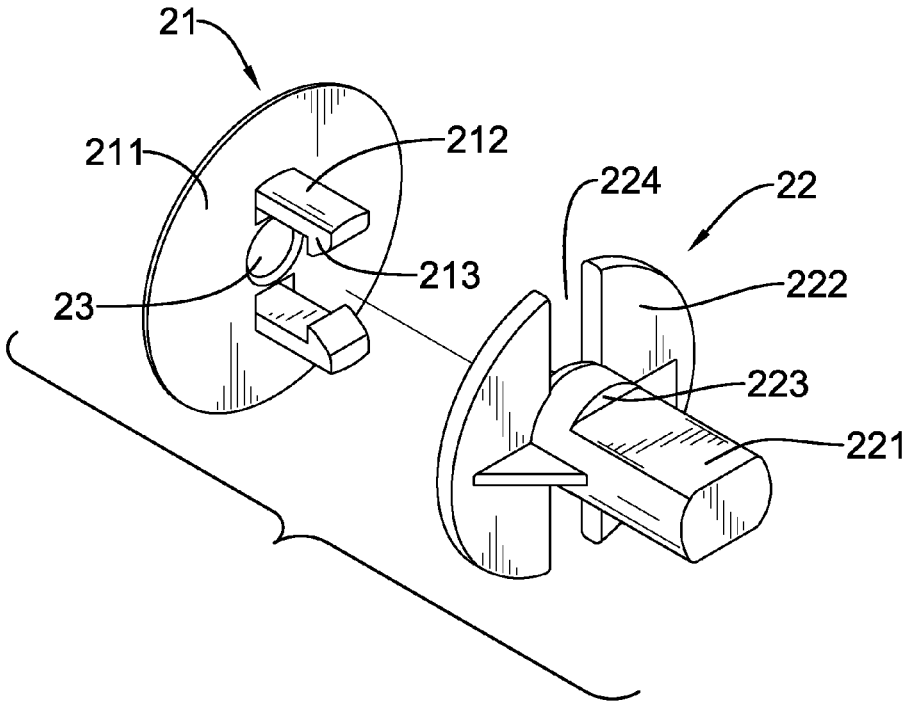
FIG. 5 is an exploded perspective view of the fixture of the present invention.
Figure 7:
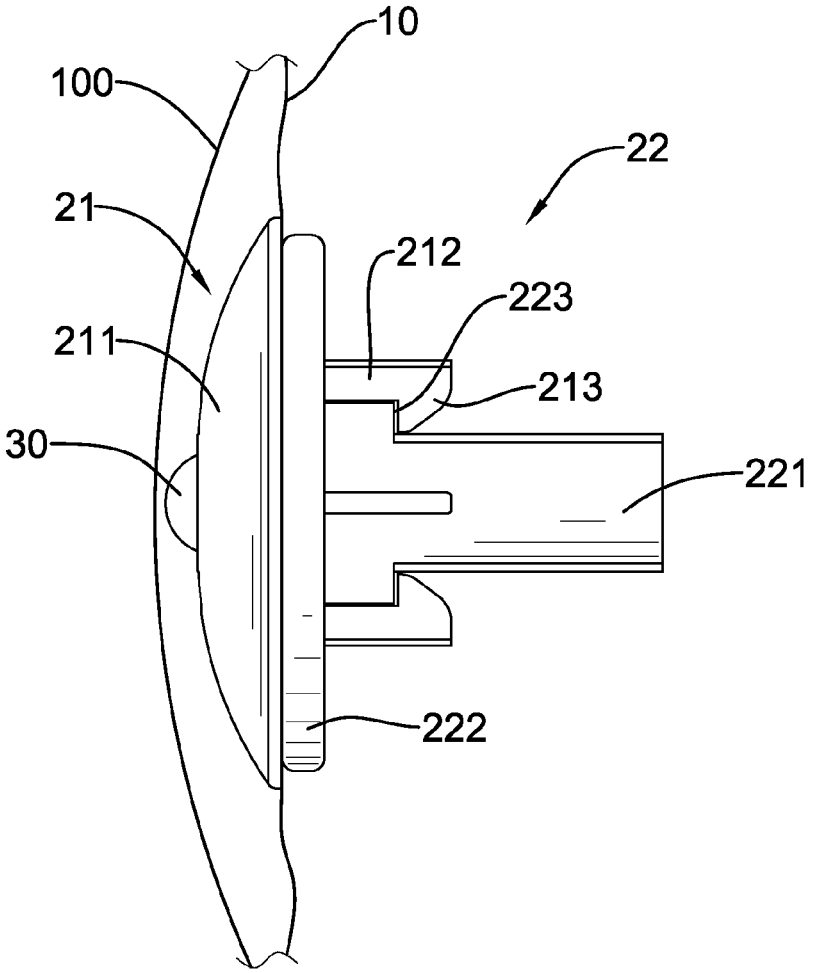
FIG. 7 is a plan view of the fixture of the present invention.

With reference to FIG. 5 and FIG. 7, the first connector 21 is mounted on the front surface of the decoration body 10 and has an opening 23. The second connector 22 is mounted on the back surface of the decoration body 10 and is engaged with the first connector 21 to be held on the decoration body 10.

The illumination units 30 are respectively mounted in the fixtures 20 and are exposed in the openings 23 of the first connectors 21 to form the patterns.

Figure 6:
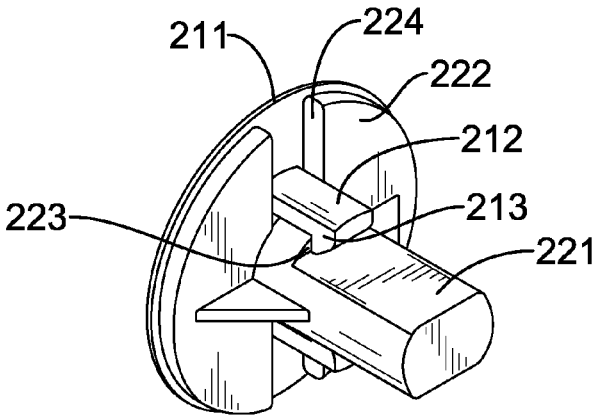
FIG. 6 is a perspective view of the fixture of the present invention.

With reference to FIG. 5 and FIG. 6, a first embodiment of an assembly of the fixture 20 and the illumination unit 30 is disclosed. The first connector 21 has a first sheet 211 and multiple buckles 212.

The first sheet 211 has the opening 23 and a back surface. The buckles 212 are formed on the back surface of the first sheet 211. Each buckle 212 has a lock portion 213 extending inward.

The second connector 22 has a base 221 and a second sheet 222. The base 221 has a front terminal and multiple abutting surfaces 223. The second sheet 222 laterally extends from the front terminal of the base 221 and has a front surface and multiple notches 224. The positions of the notches 224 correspond to the positions of the abutting surfaces 223.

The illumination unit 30 is mounted on the front terminal of the base 221. The illumination unit 30 can be a light emitting diode (LED) device. With reference to FIG. 7, a plan view of the fixture 20 is disclosed. The back surface of the first sheet 211 presses on the front surface of the decoration body 10. The front surface of the second sheet 222 presses on the back surface of the decoration body 10. The buckles 212 pass through the hole 11 of the decoration body 10 and the notches 224 of the second sheet 222. The lock portions 213 of the buckles 212 respectively abut against the abutting surfaces 223 of the base 221. The illumination units 30 are respectively exposed in the openings 23 of the first sheets 211 through the holes 11 of the decoration body 10.

The translucent cover 100 is mounted on the front surface of the decoration body 10 to cover the illumination units 30. The translucent cover 100 can be a translucent fabric or cloth.

Figure 8:
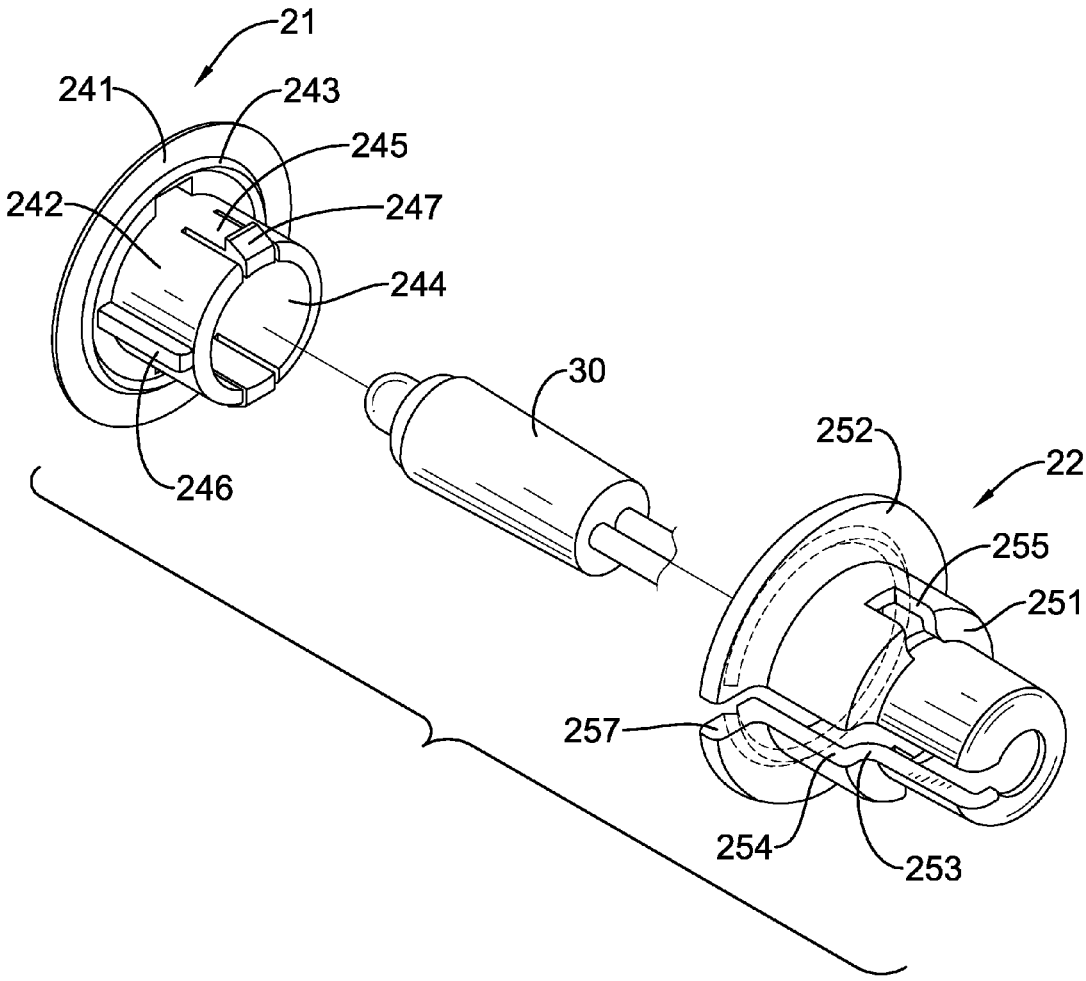
FIG. 8 is an exploded perspective view of the fixture and the illumination unit of the present invention.
Figure 9:
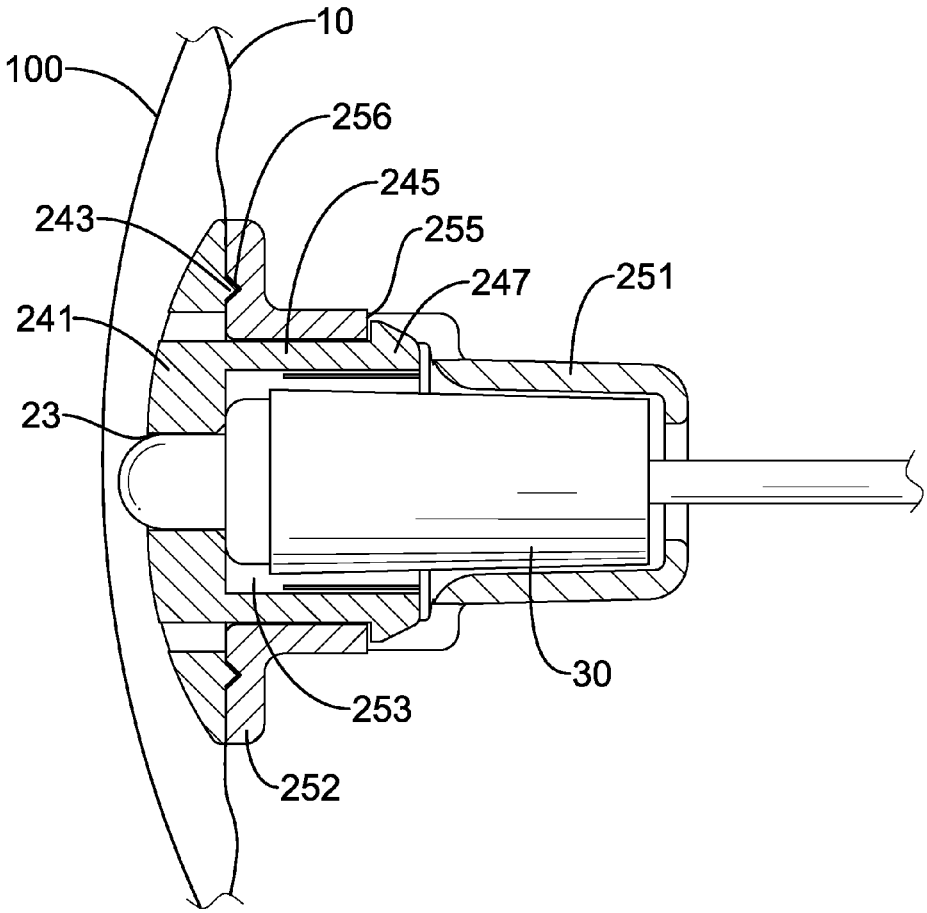
FIG. 9 is a partially cross-sectional view of the fixture and the illumination unit of the present invention.

With reference to FIG. 8 and FIG. 9, a second embodiment of an assembly of the fixture 20 and the illumination unit 30 is disclosed. The first connector 21 has a first sheet 241 and a tube 242.

The first sheet 241 has the opening 23, a first engaging portion 243 and a back surface. The first engaging portion 243 is formed on the back surface of the first sheet 241 and can be a protrusion or an indentation.

The tube 242 is formed on the back surface of the first sheet 241 and has an outer surface, a space 244, multiple buckles 245 and a positioning rib 246. The space 244 communicates with the opening 23 of the first sheet 241. Each buckle 245 has a lock portion 247 extending outward. The positioning rib 246 is formed on the outer surface of the tube 242.

The second connector 22 has a base 251 and a second sheet 252.

The base 251 has a front terminal, a bottom terminal, a space 253, a positioning groove 254 and multiple apertures 255. The space 253 has a front opening formed in the front terminal of the base 251. The positioning groove 254 is laterally formed through the base 251 and extends from the front terminal to the bottom terminal of the base 251. The apertures 255 are formed between the front terminal and the bottom terminal of the base 251 and communicate with the space 253 of the base 251. The positions of the apertures 255 correspond to the positions of the buckles 245. The position of the positioning groove 254 corresponds to the position of the positioning rib 246.

The second sheet 252 laterally extends from the front terminal of the base 251 and has a front surface, a second engaging portion 256 and a through groove 257. The second engaging portion 256 is formed on the front surface of the second sheet 252 and matches the first engaging portion 243 to be an indentation or a protrusion. The through groove 257 extends from an edge of the second sheet 252 to the positioning groove 254 and communicates with the positioning groove 254.

The illumination unit 30 is mounted in the fixture 20 and can be an LED device. With reference to FIG. 9, a plan view of the fixture 20 is disclosed. The back surface of the first sheet 241 presses on the front surface of the decoration body 10. The front surface of the second sheet 252 presses on the back surface of the decoration body 10. The tube 242 of the first connector 21 passes through the hole 11 of the decoration body 10 and enters the space 253 of the base 251 of the second connector 22. The lock portions 247 of the buckles 245 respectively engage the apertures 255 of the base 251. The decoration body 10 is pressed between the first engaging portion 243 and the second engaging portion 256. The illumination unit 30 is mounted in the space 253 of the base 251 and is exposed in the opening 23 of the first sheet 241 through the space 244 of the tube 242.

When a user connects the first connector 21 with the second connector 22, the user can insert the positioning rib 246 into the positioning groove 254 to align the apertures 255 with the buckles 245 such that the positions of the apertures 255 correspond to the positions of the buckles 245, and the position of the positioning groove 254 corresponds to the position of the positioning rib 246.

Figure 10:
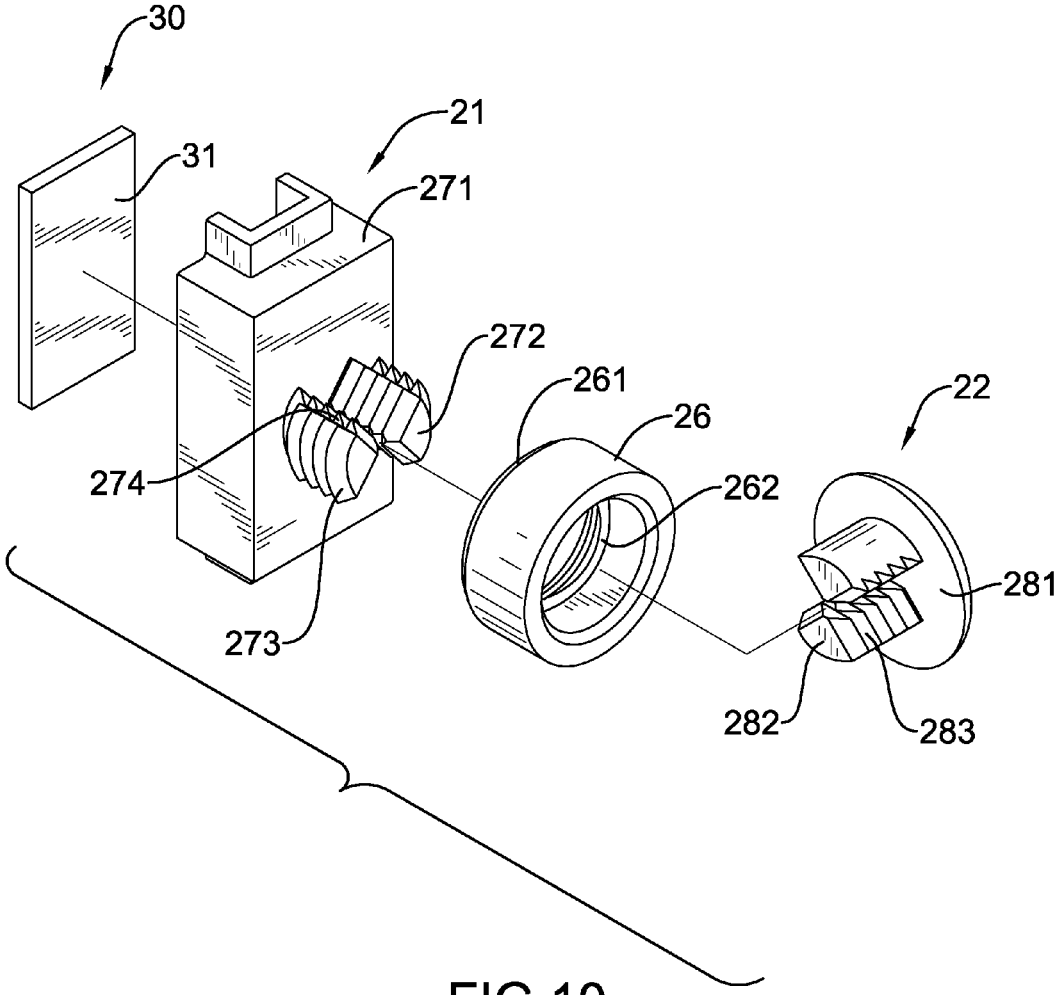
FIG. 10 is an exploded perspective view of the fixture and the illumination unit of the present invention.
Figure 11:
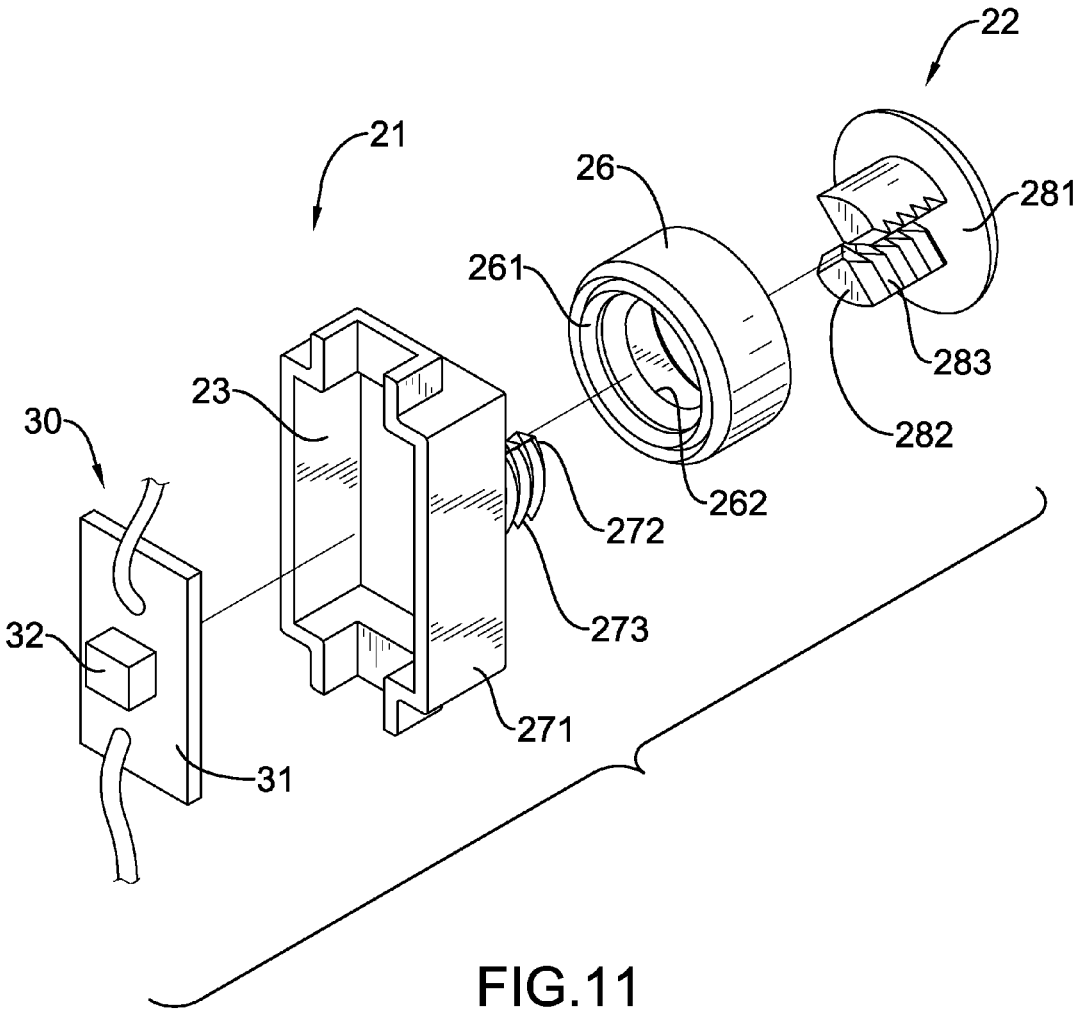
FIG. 11 is an exploded perspective view of the fixture and the illumination unit of the present invention.
Figure 12:
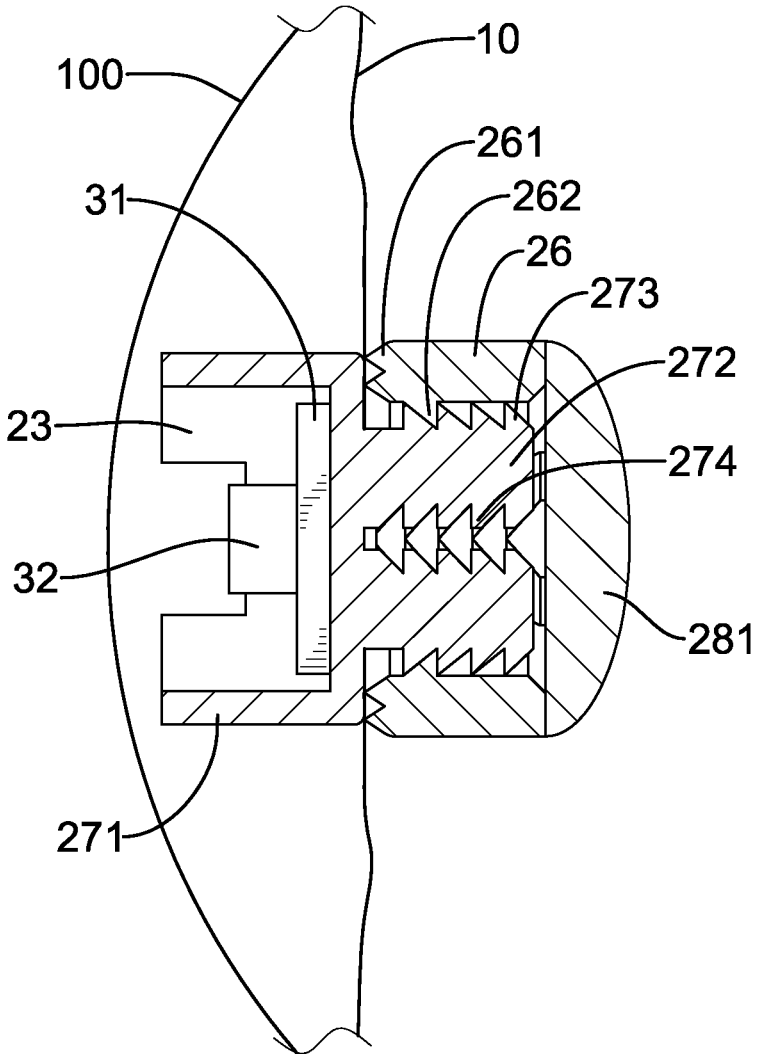
FIG. 12 is a partially cross-sectional view of the fixture and the illumination unit of the present invention.

With reference to FIGS. 10-12, a third embodiment of an assembly of the fixture 20 and the illumination unit 30 is disclosed. The fixture 20 further has a ring 26. The ring 26 has a front terminal, a bottom terminal, an inner surface, an abutting portion 261 and a locking protrusion 262. The abutting portion 261 is formed forward on the front terminal of the ring 26. The locking protrusion 262 is formed on the inner surface of the ring 26.

The first connector 21 has a box 271 and a first engagement pillar 272.

The box 271 has the opening 23 and a back surface. The first engagement pillar 272 is formed on the back surface of the box 271 and has an outer engagement portion 273 and an inner engagement portion 274.

The second connector 22 has a bottom piece 281 and a second engagement pillar 282. The bottom piece 281 has a front surface. The second engagement pillar 282 is formed on the front surface of the bottom piece 281 and has an inner engagement portion 283.

The illumination unit 30 is mounted in the opening 23 of the box 271 and has a substrate 31 and an LED die 32. The substrate 31 has a front surface. The LED die 32 is mounted on the front surface of the substrate 31.

With reference to FIG. 12, a plan view of the fixture 20 is disclosed. The back surface of the box 271 presses on the front surface of the decoration body 10. The first engagement pillar 272 passes through the hole 11 of the decoration body 10. The inner engagement portion 283 of the second engagement pillar 282 is engaged with the inner engagement portion 274 of the first engagement pillar 272. The ring 26 is mounted around the first engagement pillar 272 and the second engagement pillar 282. The abutting portion 261 of the ring 26 presses on the back surface of the decoration body 10. The bottom terminal of the ring 26 touches the front surface of the bottom piece 281. The locking protrusion 262 of the ring 26 is engaged with the outer engagement portion 273 of the first engagement pillar 272.

Figure 13:
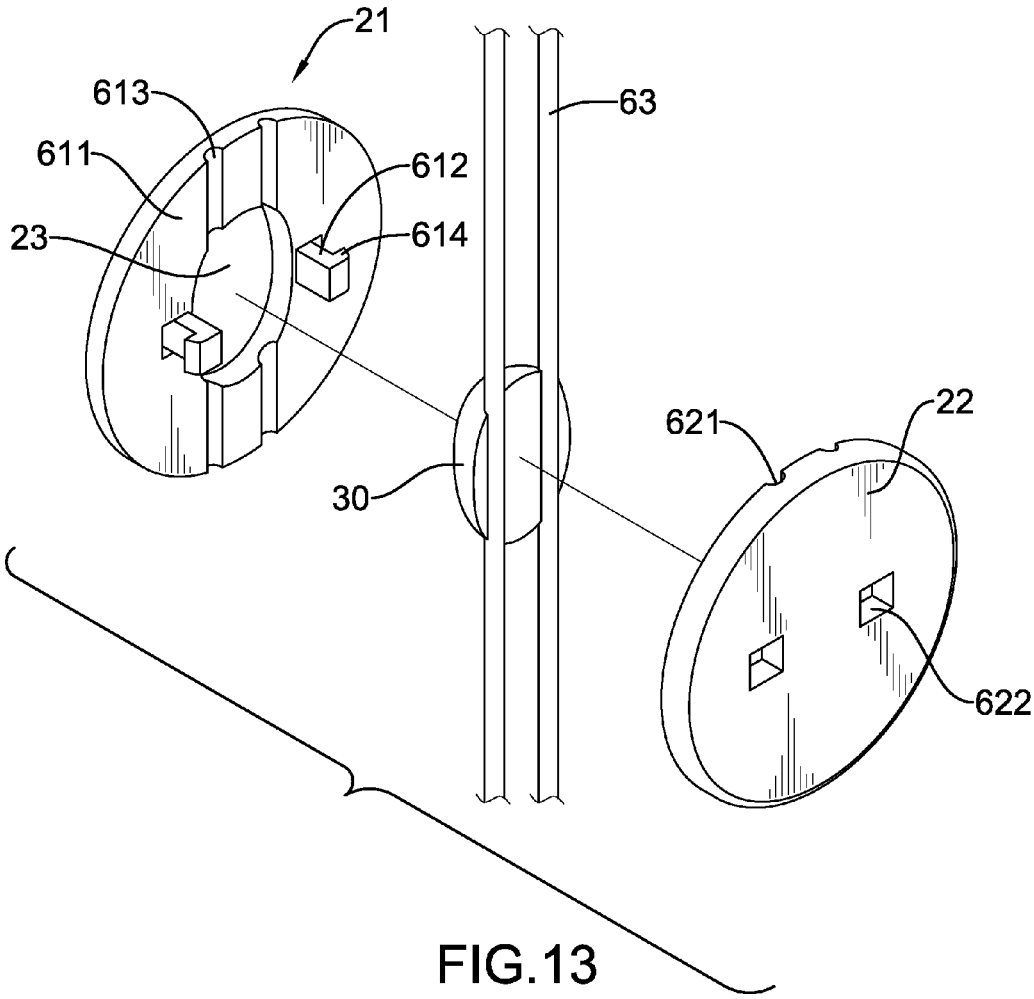
FIG. 13 is an exploded perspective view of the fixture and the illumination unit of the present invention.
Figure 14:
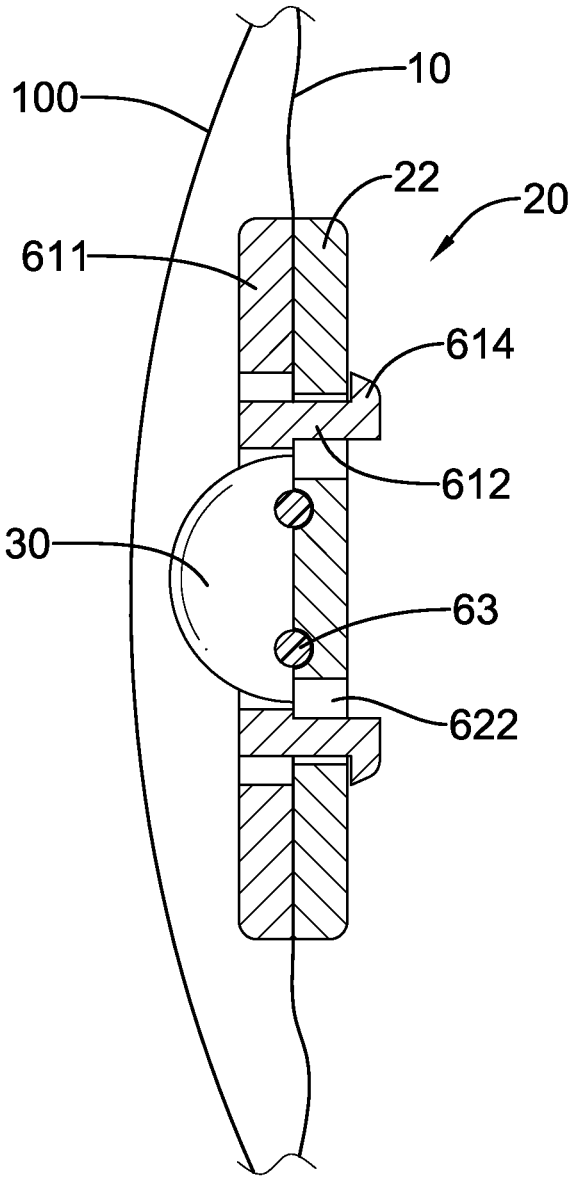
FIG. 14 is a partially cross-sectional view of the fixture and the illumination unit of the present invention.

With reference to FIG. 13 and FIG. 14, a fourth embodiment of an assembly of the fixture 20 and the illumination unit 30 is disclosed. The first connector 21 has a first sheet 611 and multiple buckles 612.

The first sheet 611 has the opening 23, a back surface and two wire grooves 613. The wire grooves 613 are formed in the back surface of the first sheet 611. The buckles 612 are formed on the back surface of the first sheet 611. Each buckle 612 has a lock portion 614 extending outward.

The second connector 22 is a sheet having a front surface, two wire grooves 621 and two apertures 622. The wire grooves 621 are formed in the front surface of the second connector 22 and respectively correspond to the wire grooves 613 of the first sheet 611. The apertures 622 are formed through the second connector 22.

The illumination unit 30 can be an LED package and is mounted on the front surface of the second connector 22. Two adjacent illumination units 30 are connected in series by two wires 63.

With reference to FIG. 14, when the first connector 21 is mounted on the second connector 22, the back surface of the first sheet 611 presses on the front surface of the decoration body 10 and the front surface of the second connector 22 presses on the back surface of the decoration body 10. The buckles 612 of the first connector 21 pass through the hole 11 of the decoration body 10. The lock portions 614 respectively engage the apertures 622 of the second connector 22. The illumination units 30 are respectively exposed in the openings 23 of the first sheets 611 through the holes 11 of the decoration body 10. The wires 63 are mounted in the wire grooves 613, 621 of the first connector 21 and the second connector 22 and extend externally from the fixture 20.

Figure 3A:
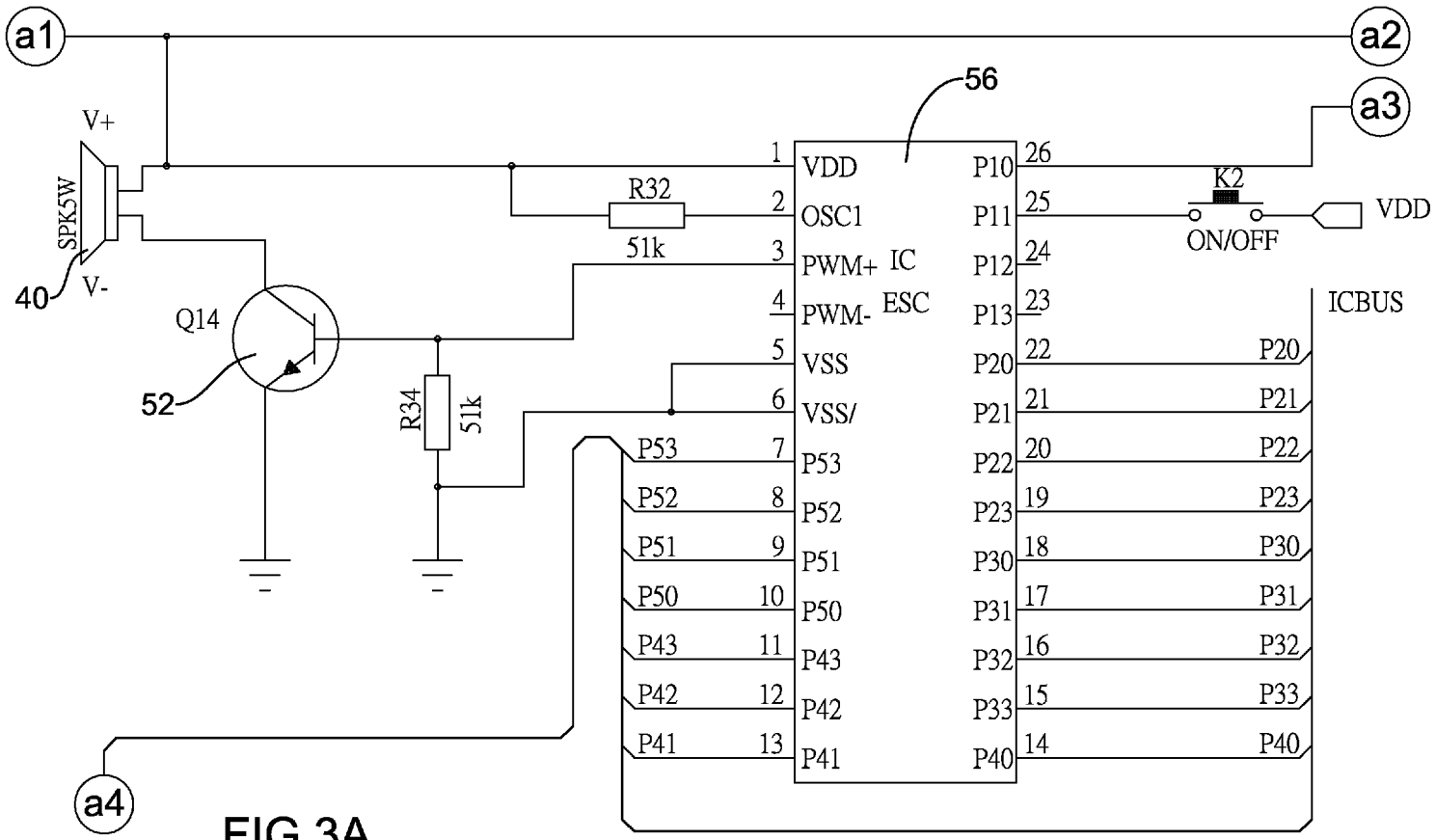
FIGS. 3A-3F are detailed circuit diagrams of the control device of the present invention.
Figure 3B:
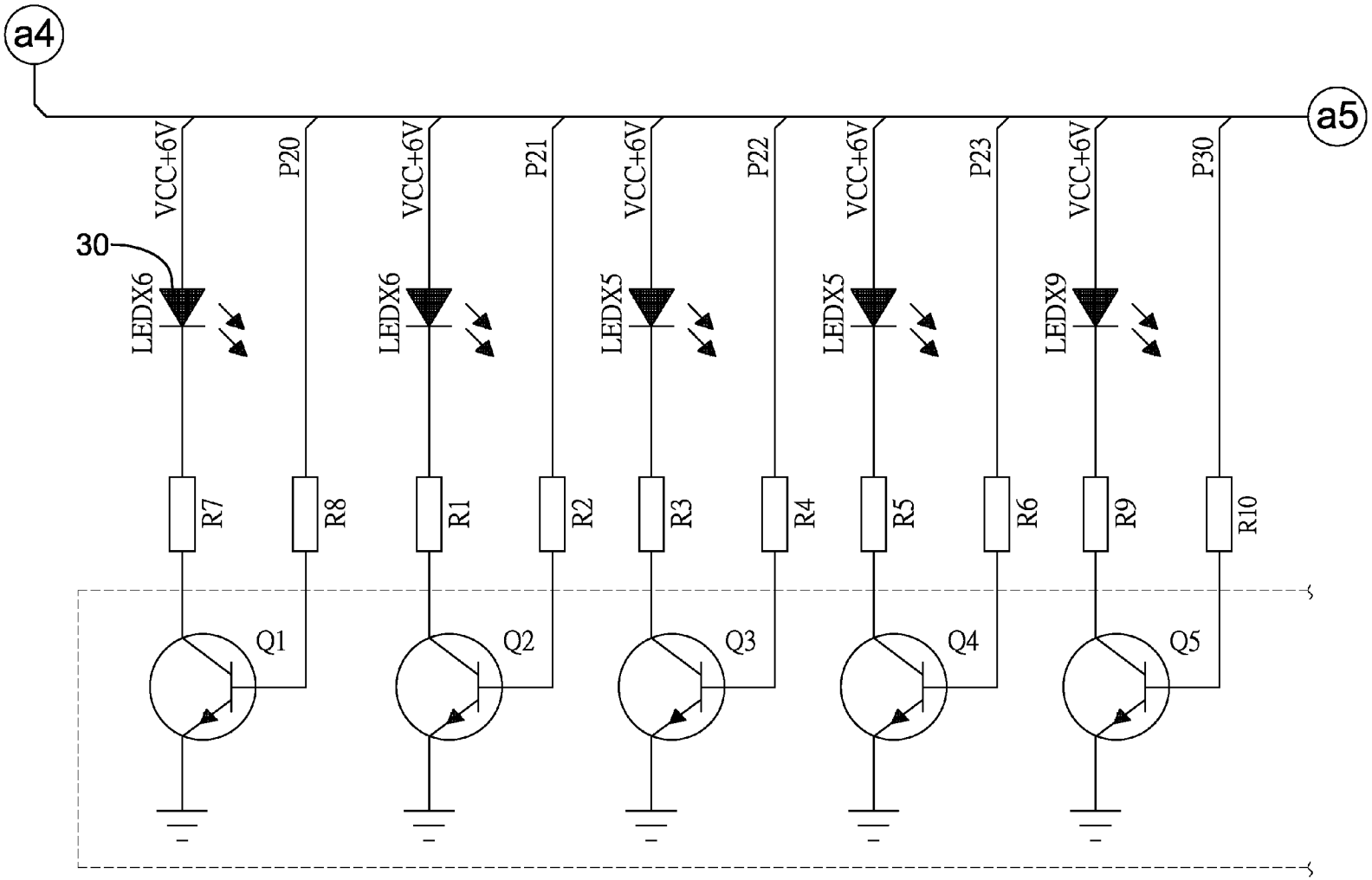
Figure 3C:
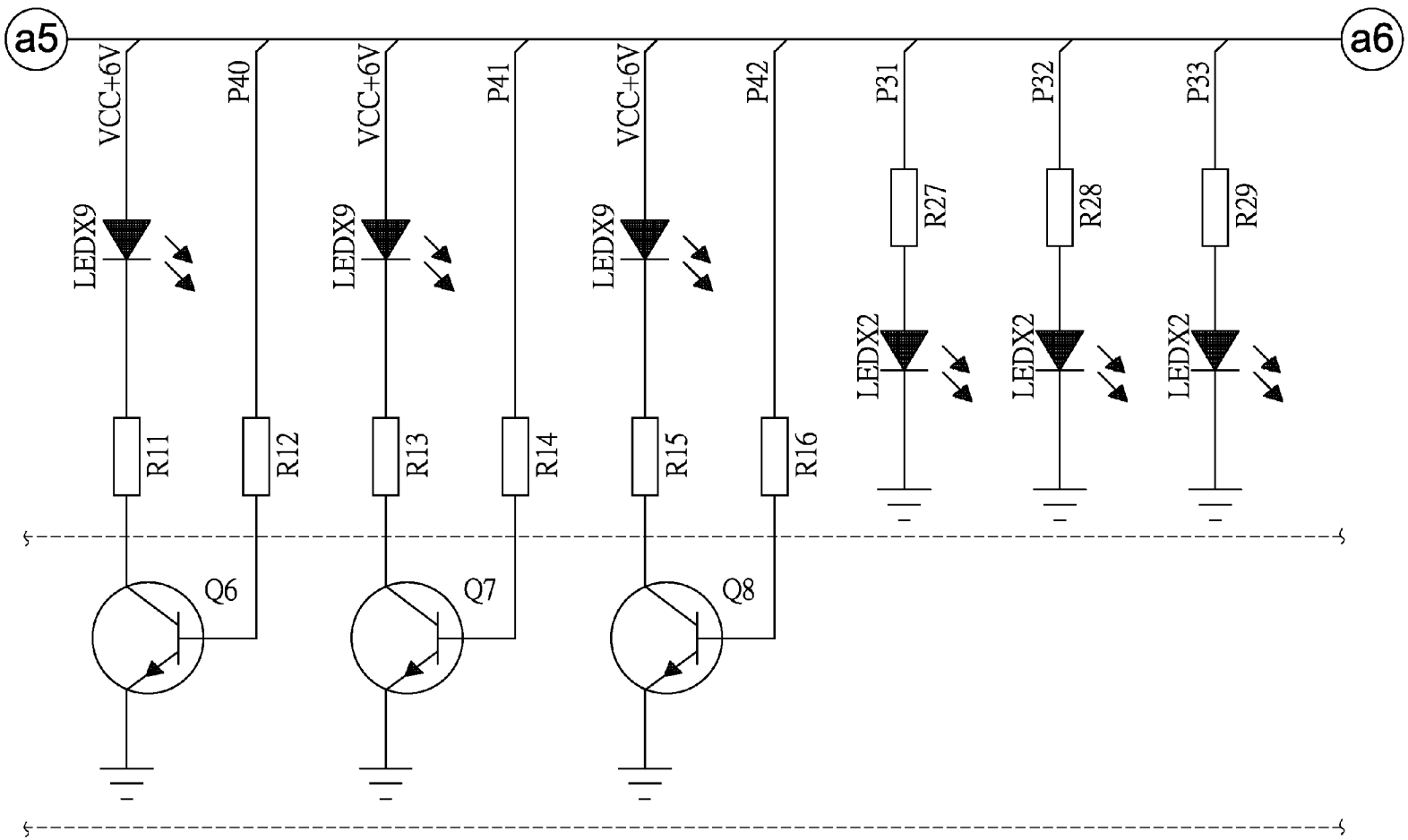
Figure 3D:
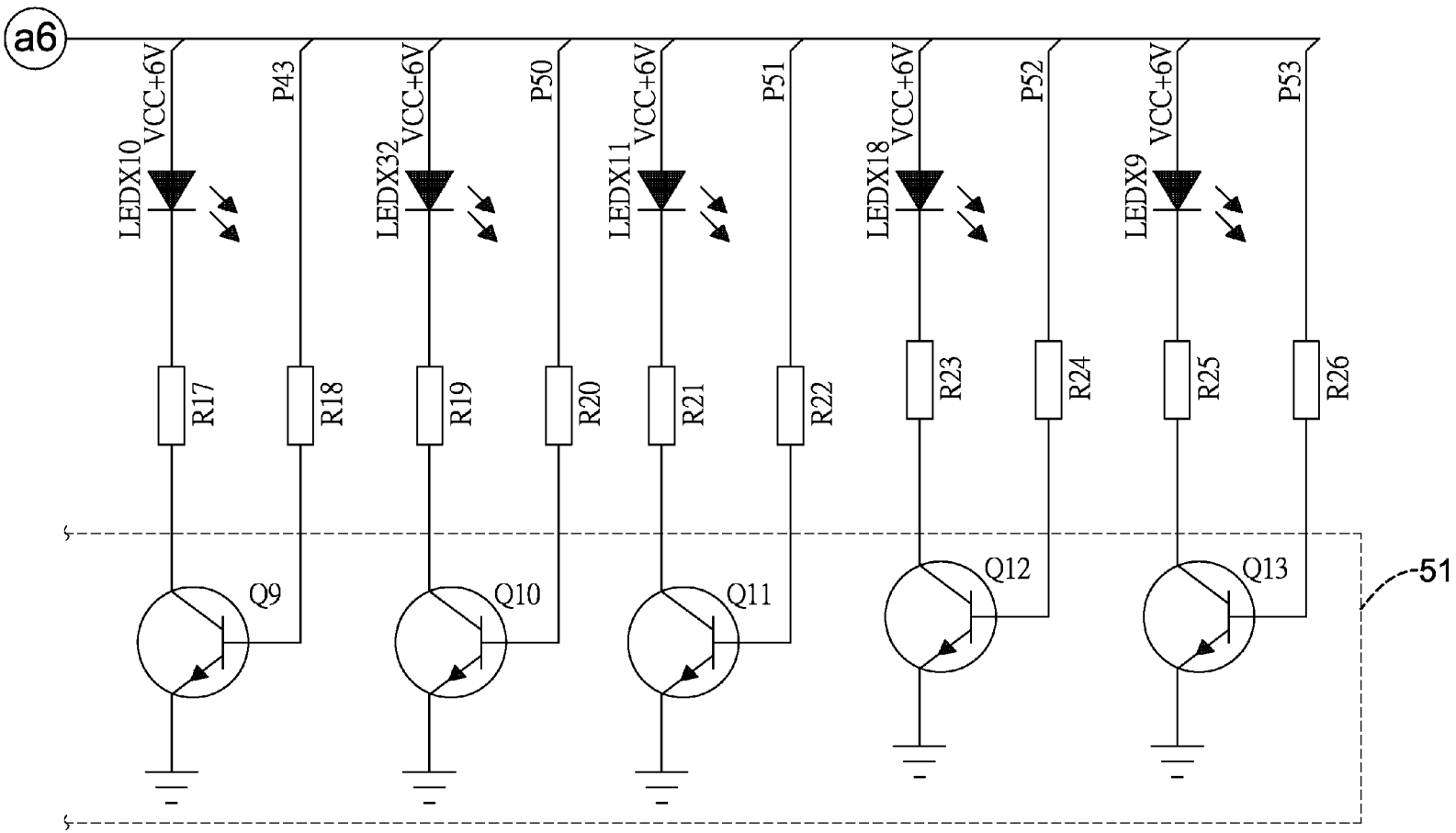
Figure 3E:
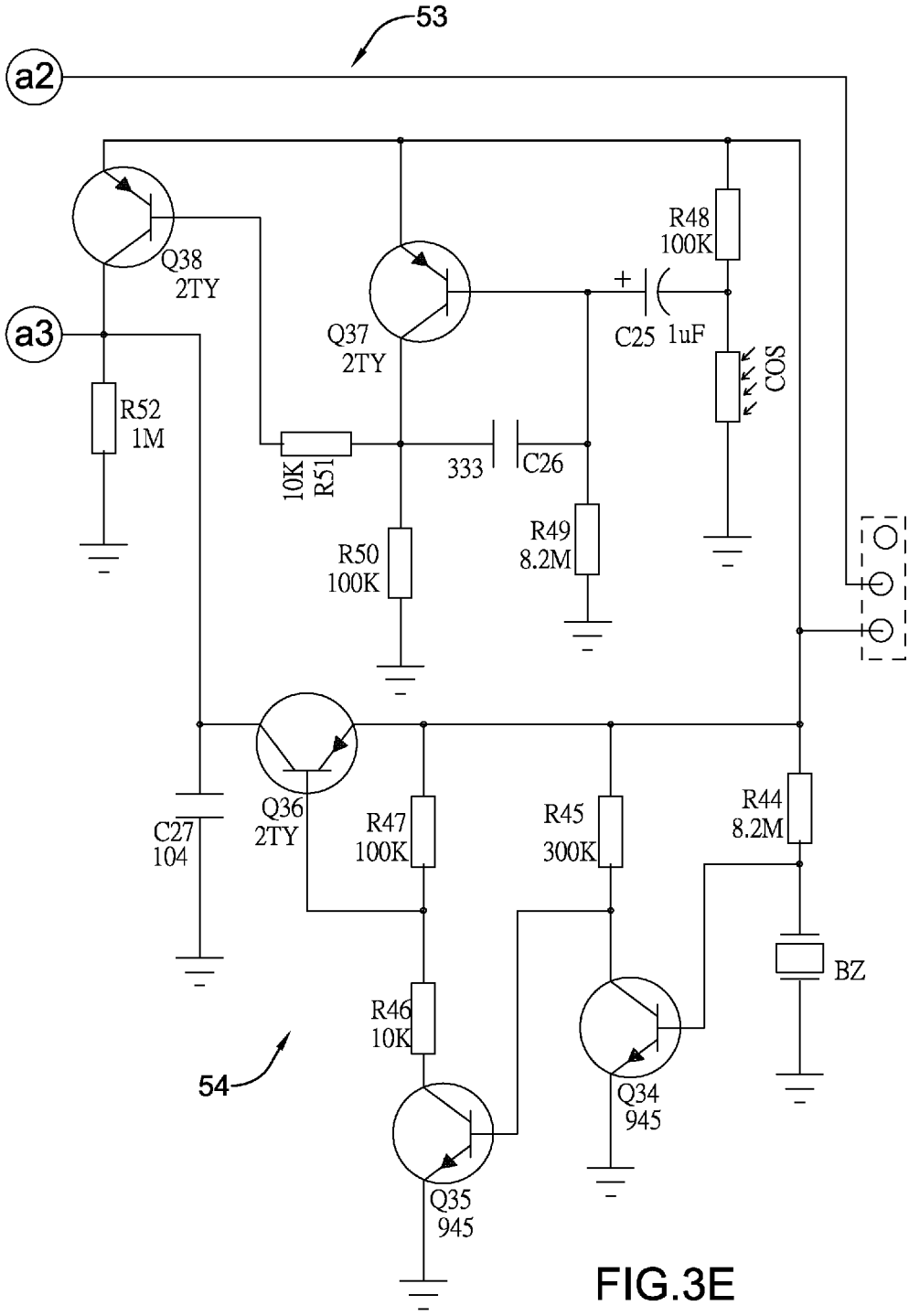
Figure 3F:
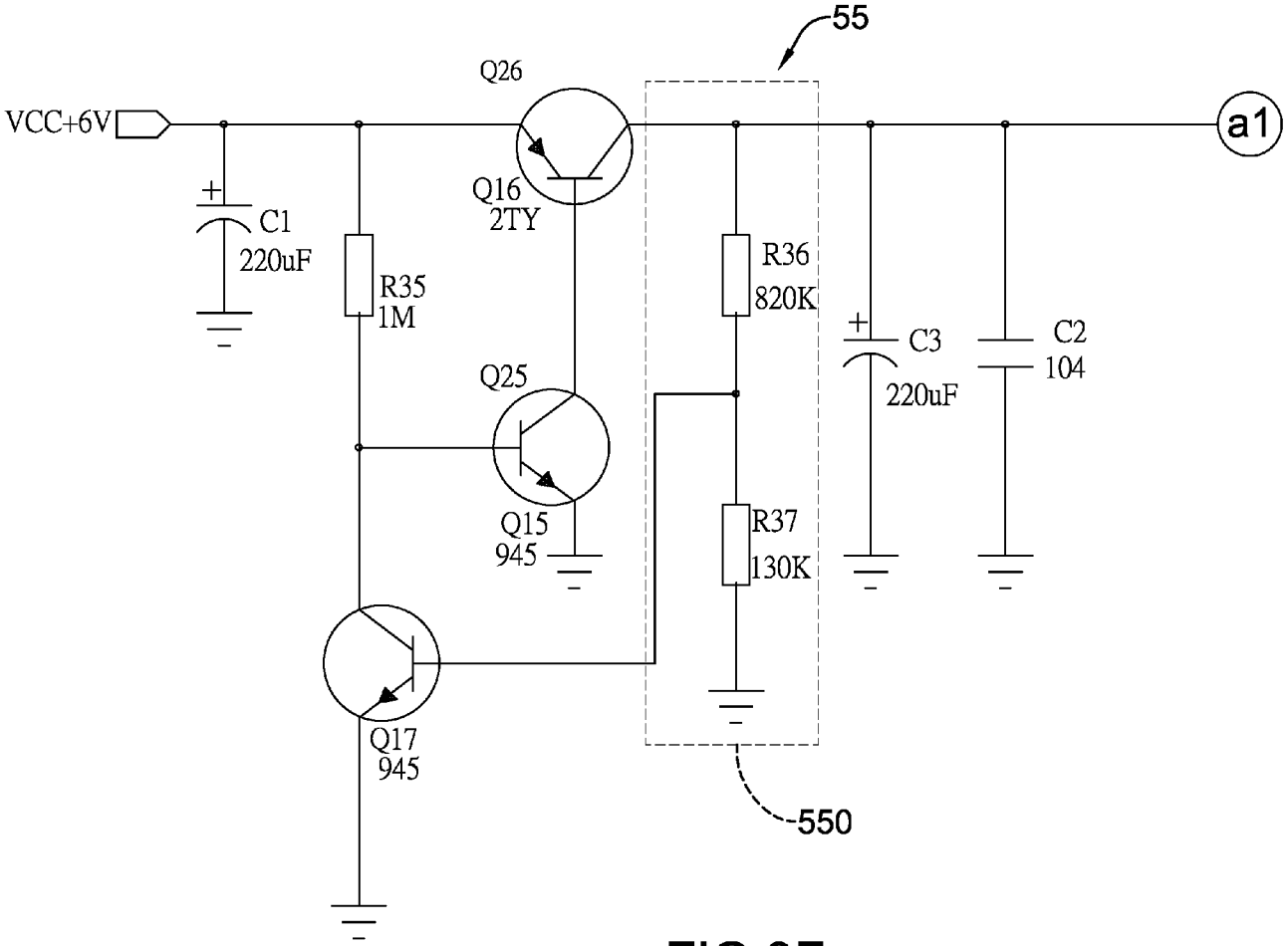
Figure 4A:
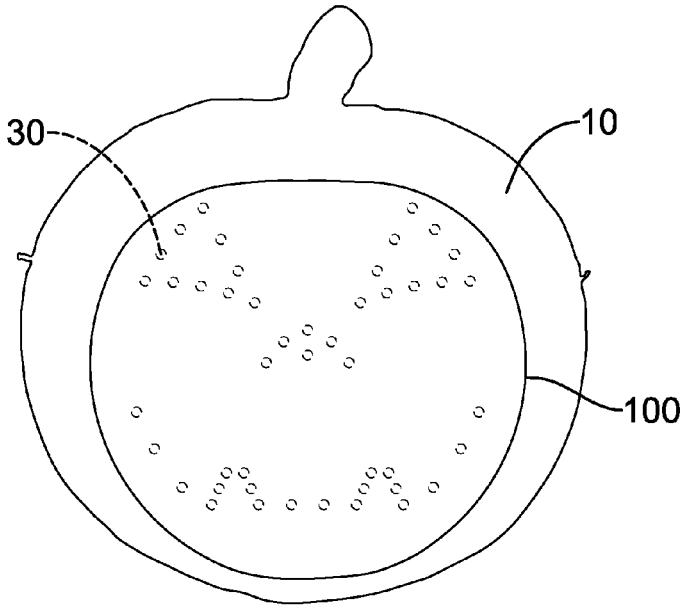
FIGS. 4A-4F are plan views of different patterns of the present invention.
Figure 4B:
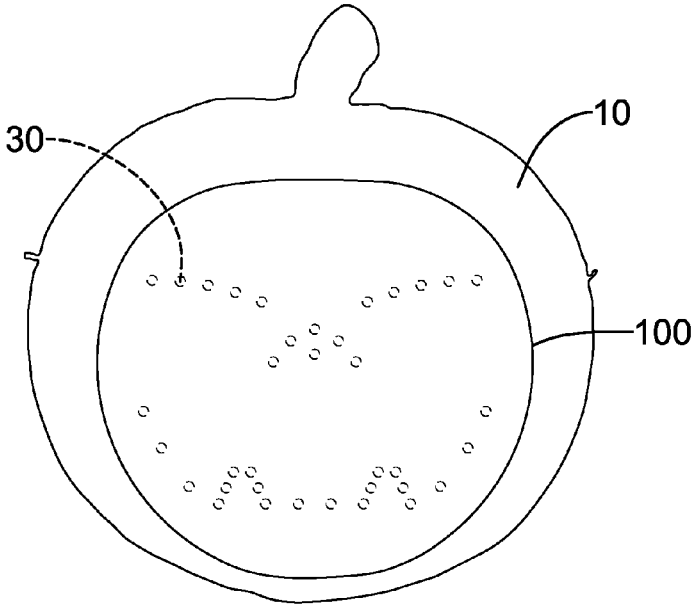
Figure 4C:
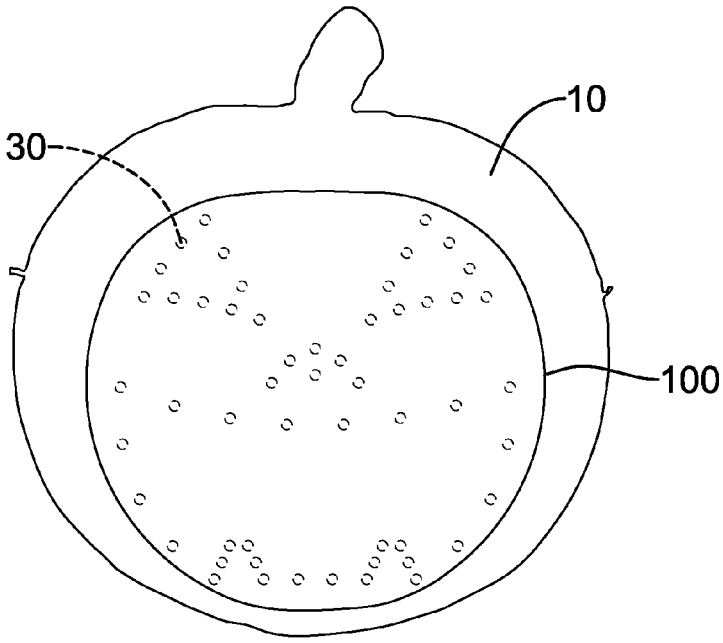
Figure 4D:
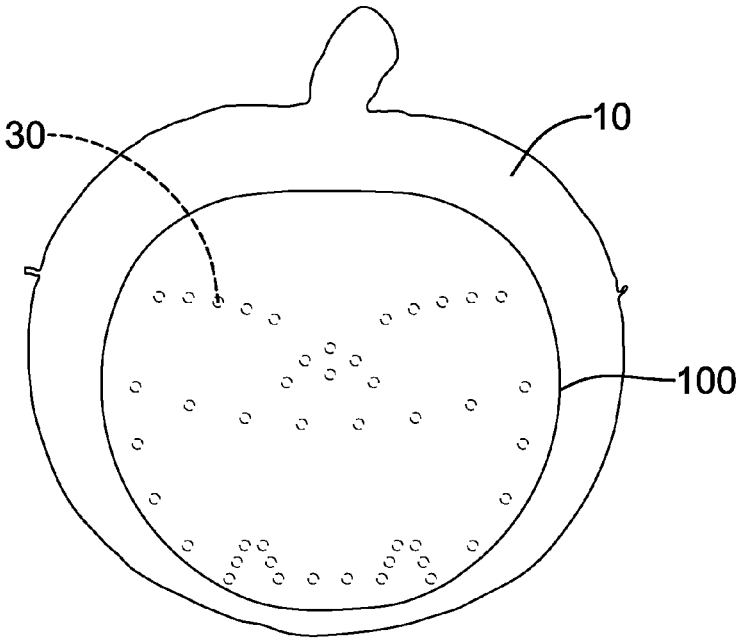
Figure 4E:
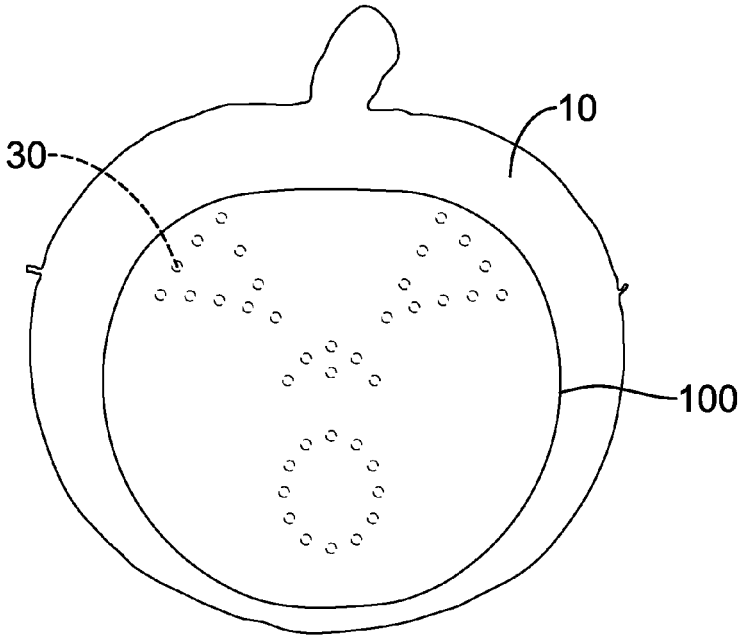
Figure 4F:
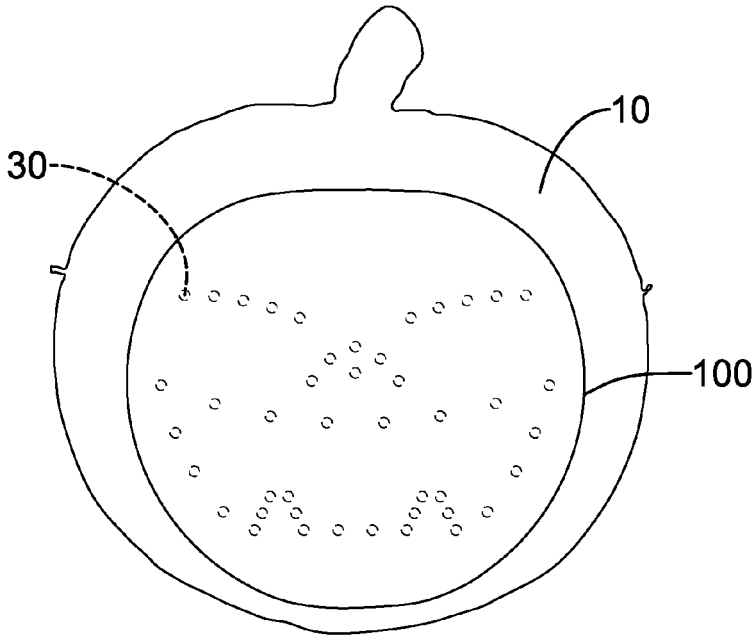

With reference to FIG. 3A, the speaker 40 has a signal input pin V− and a power pin V+. The signal input pin V− receives multiple sound signals from the control device 50. The speaker 40 makes different voices according to different sound signals. The voices respectively correspond to the patterns of the decoration body 10. For example, the voices corresponding to the patterns of FIG. 4A-4F are different from each other.

With reference to FIGS. 3A-3F, the control device 50 has a light driver circuit 51, a sound driver 52, a light-controlled circuit 53, a voice-controlled circuit 54, an overload protection circuit 55 and a micro controller 56.

The light driver circuit 51 has multiple electric switches Q1-Q13 respectively and electrically connected to the illumination units 30. The illumination units 30 are LEDs as an example, wherein each LED has a cathode and an anode. The electric switch Q1-Q13 can be an NPN bipolar junction transistor (BJT) having a base, a collector and an emitter. The emitter is grounded. The collector is electrically connected to the cathode of the illumination unit 30.

The sound driver 52 can be an NPN BJT having a base, a collector and an emitter. The emitter is grounded. The collector is electrically connected to the signal input pin V− of the speaker 40.

The light-controlled circuit 53 has a first PNP BJT Q37, a second PNP BJT Q38, a photoresistor (COS) and a resistor R52. The base of the first PNP BJT Q37 is grounded through the photoresistor (COS). The collector of the second PNP BJT Q38 is connected to the micro controller 56 and is grounded through the resistor R52.

The voice-controlled circuit 54 has a first NPN BJT Q34, a second NPN BJT Q35, a PNP BJT Q36 and an acoustic resistor (BZ). The base of the first NPN BJT Q34 is grounded through the acoustic resistor (BZ). The collector of the PNP BJT Q36 is connected to the micro controller 56 and is grounded through the resister R52 of the light-controlled circuit 53. The second NPN BJT Q35 is connected between the first NPN BJT Q34 and the PNP BJT Q36.

The overload protection circuit 55 has a PNP BJT Q16, a first NPN BJT Q15, a second NPN BJT Q17 and a voltage divider 550.

The PNP BJT Q16 has a base, a collector and an emitter. The emitter is electrically connected to a DC power supply to receive a working voltage VCC. The collector is electrically connected to the micro controller 56, the anodes of the illumination units 30, the power pin V+ of the speaker 40, emitters of the first and the second PNP BJT Q37, Q38 and the photoresistor (COS) of the light-controlled circuit 53 and an emitter of the PNP BJT Q36 and the acoustic resistor (BZ) of the voice-controlled circuit 54.

The first NPN BJT Q15 has a base, a collector and an emitter. The emitter is grounded. The base and the collector of the first NPN BJT Q15 are respectively and electrically connected to the emitter and the base of the PNP BJT Q16.

The voltage divider 550 has a first resistor R36 and a second resistor R37. The first resistor R36 is electrically connected to the collector of the PNP BJT Q16. The second resistor R37 is electrically connected to the first resistor R36 in series. The resistance of the second resistor R37 is lower than that of the first resistor R36.

The second NPN BJT Q17 has a base, a collector and an emitter. The emitter is grounded. The base is electrically connected to a node between the first resistor R36 and the second resistor R37. The collector is electrically connected to the emitter of the PNP BJT Q16.

When the DC power supply works normally, the voltage drop of the second resistor R37 is lower than a threshold voltage of the second NPN BJT Q17. Then the NPN BJT Q17 is inactivated and operates in a cutoff region. The first NPN BJT Q15 and the PNP BJT Q16 are activated and operate in a forward active region. When the PNP BJT Q16 is activated, the working voltage VCC is conveyed from the emitter to the collector of the PNP BJT Q16 for supplying the micro controller 56, the light-controlled circuit 53, the voice-controlled circuit 54, the speaker 40 and the illumination units 30.

When the DC power supply provides abnormally high working voltage, the voltage drop of the second resistor R37 increases to be higher than the threshold voltage of the second NPN transistor Q17, such that the second NPN BJT Q17 is activated. When the second NPN BJT Q17 is activated, the DC power supply is grounded by the second NPN BJT Q17. Hence, the abnormally high working voltage cannot be conveyed to the micro controller 56, the speaker 40 and the illumination units 30. The micro controller 56, the speaker 40 and the illumination units 30 are protected from being damaged by the abnormally high working voltage.

The micro controller 56 has a power pin VDD, a sound output pin PWM+, a voice-light input pin P10 and multiple light output pins P20-P23, P30-P33, P40-P43, P50-P53. The micro controller 56 stores the sound signals and executes multiple modes sequentially. The sound signals are pulse width modulation (PWM) signals.

The power pin VDD is electrically connected to the collector of the PNP BJT Q16 of the overload protection circuit 55 to receive the working voltage VCC.

The sound output pin PWM+ is electrically connected to the base of the sound driver 52. The micro controller 56 provides the sound signals to the sound driver 52 via the sound output pin PWM+, such that the micro controller 56 drives the speaker 40 speaking through the sound driver 52.

The voice-light input pin P10 is electrically connected to the light-controlled circuit 53 and the voice-controlled circuit 54. The micro controller 56 is activated by the light-controlled circuit 53 or the voice-controlled circuit 54.

The voice-light input pin P10 is connected to the collector of the second PNP BJT Q38 of the light-controlled circuit 53 and the collector of the PNP BJT Q36 of the voice-controlled circuit 54. The micro controller 56 can be activated by the light-controlled circuit 53 and the voice-controlled circuit 54.

In the light-controlled circuit 53, when the photoresistor (COS) detects light, the impedance of the photoresistor (COS) decreases. The first PNP BJT Q37 is then turned ON. When the first PNP BJT Q37 is turned ON, the collector of the first PNP BJT Q37 is maintained in a low potential, so that the second PNP BJT Q38 is turned ON. When the second PNP BJT Q38 is turned ON, a current flows through the resistor R52. The voltage drop on the resistor R52 then activates the micro controller 56.

In the voice-controlled circuit 54, when the acoustic resistor (BZ) detects sound waves, the impedance of the acoustic resistor (BZ) decreases. The first NPN BJT Q34 is then turned OFF, so that the base of the second NPN BJT Q35 is maintained in a high potential and the second NPN BJT Q35 is turned ON. When the second NPN BJT Q35 is turned ON, the base of the PNP BJT Q36 is maintained in a low potential, so that the PNP BJT Q36 is turned ON. When the PNP BJT Q36 is turned ON, a current flows through the resistor R52 of the light-controlled circuit 53. The voltage drop on the resistor R52 then activates the micro controller 56.

The user can remotely activate the micro controller 56 by making sounds to the acoustic resistor (BZ) or shining a flash light on the photoresistor (COS). When the micro controller 56 is activated by sounds or light, the micro controller 56 outputs the sound signals and the control signals to the speaker 40 and the illumination units 30 to activate the speaker 40 and the illumination units 30.

The light output pins P20-P23, P30-P33, P40-P43, P50-P53 are respectively and electrically connected to the bases of the electric switches Q1-Q13 of the light driver circuit 51. The micro controller 56 provides control signals to the part of the electric switches Q1-Q13 via the light output pins to activate the part of the electric switches Q1-Q13 to form the pattern. When the electric switches Q1-Q13 are activated, the illumination units 30 receive the working voltage VCC to be lighted up.

The micro controller 56 executes the modes sequentially. Each mode is adapted to activate a part of the illumination units 30 for a certain pattern and to output a corresponding voice by the speaker 40.

For example, the patterns of the FIGS. 4A-4F are respectively defined as a first, a second, a third, a fourth, a fifth and a sixth pattern. The micro controller 56 stores six different sound signals respectively corresponding to the six patterns. The micro controller 56 executes six modes sequentially.

The patterns and the voices change synchronously. When the micro controller 56 executes a first mode, the micro controller 56 activates the part of the illumination units 30 for the first pattern and activates the speaker 40 by a first sound signal. When the micro controller 56 executes a second mode, the micro controller 56 activates the part of the illumination units 30 for the second pattern and activates the speaker 40 by a second sound signal. The rest may be deduced by analogy.

Hence, the patterns can be designed to be on display in a preset time order or in random. When the patterns are changed sequentially, the patterns are displayed as an animation. In addition, the speaker 40 makes a corresponding voice for the pattern. The decoration body 10, such as the pumpkin figurine, resembles a person in figure. The decoration lamp of the present invention can be lighted and speaks like a person to surprise and amuse the users who see and hear the decoration lamp. The conventional figurine is unable to be lighted and speaks.

In addition, when the holes 11 of the decoration body 10 are formed, the first connector 21, the second connector 22 and the illumination unit 30 are easily to be mounted on the decoration body 10 through the holes. To realize the design and assembly of the decoration lamp of the present invention is simple.

What is claimed is:

1. A decoration lamp for producing matched sound and illumination effects, the decoration lamp comprising:

a decoration body having a front surface and a back surface;

multiple fixtures mounted on the decoration body and respectively having:

a first connector mounted on the front surface of the decoration body and having an opening; and a second connector mounted on the back surface of the decoration body and engaging with the first connector;

multiple illumination units respectively mounted in the fixtures and exposed in the openings of the first connectors;

a translucent cover mounted on the front surface of the decoration body to cover the illumination units;

a speaker making different voices according to different sound signals; and a control device storing the sound signals, electrically connected to the illumination units and the speaker, and sequentially executing multiple modes, wherein each mode is applied to activate a part of the illumination units to form a certain pattern and to output one of the voices corresponding to the certain pattern by the speaker.

2. The decoration lamp as claimed in claim 1, wherein the control device has:

a light driver circuit having multiple electric switches respectively connected to the illumination units and activating the part of the illumination units according to control signals;

a sound driver electrically connected to the speaker to activate the speaker according to the sound signals; and a micro controller electrically connected to the electric switches and the sound driver, storing the sound signals and executing the modes to provide the sound signals and the control signals.

3. The decoration lamp as claimed in claim 2, wherein the control device has a light-controlled circuit and a voice-controlled circuit electrically connected to the micro controller.

4. The decoration lamp as claimed in claim 3, wherein the control device has an overload protection circuit electrically connected to the micro controller, the speaker and the illumination units.

5. The decoration lamp as claimed in claim 2, wherein:

the micro controller has:

a power pin receiving a working voltage;

a sound output pin providing the sound signals; and multiple light output pins providing the control signals;

the illumination units are LEDs respectively having:

an anode receiving the working voltage; and a cathode;

each electric switch of the light driver circuit is an NPN BJT having:

a base connected to the light output pin of the micro controller;

a collector connected to the cathode of the illumination unit; and an emitter being grounded;

the speaker has:

a power pin receiving the working voltage; and a signal input pin; and the sound driver is an NPN BJT having:
a base connected to the sound output pin of the micro controller;
a collector connected to the signal input pin of the speaker; and
an emitter being grounded.

6. The decoration lamp as claimed in claim 3, wherein:
the micro controller has:
a power pin receiving a working voltage;
a sound output pin providing the sound signals;
multiple light output pins providing the control signals; and
a voice-light input pin connected to the light-controlled circuit and the voice-controlled circuit;
the illumination units are LEDs respectively having:
an anode receiving the working voltage; and
a cathode;
each electric switch of the light driver circuit is an NPN BJT having:
a base connected to the light output pin of the micro controller;
a collector connected to the cathode of the illumination unit; and
an emitter being grounded;
the speaker has:
a power pin receiving the working voltage; and
a signal input pin; and
the sound driver is an NPN BJT having:
a base connected to the sound output pin of the micro controller;
a collector connected to the signal input pin of the speaker; and
an emitter being grounded.

7. The decoration lamp as claimed in claim 4, wherein:
the micro controller has:
a power pin;
a sound output pin providing the sound signals;
multiple light output pins providing the control signals; and
a voice-light input pin connected to the light-controlled circuit and the voice-controlled circuit;
the illumination units are LEDs respectively having:
an anode receiving a working voltage; and
a cathode;
the control device has an overload protection circuit having:
a PNP BJT having:
a base;
an emitter receiving the working voltage; and
a collector connected to the power pin of the micro controller;
a first NPN BJT having:
a base connected to the emitter of the PNP BJT;
a collector connected to the base of the PNP BJT; and
an emitter being grounded;
a voltage divider having:
a first resistor connected to the collector of the PNP BJT; and
a second resistor connected to the first resistor in series and having a lower resistance than the first resistor; and
a second NPN BJT having:
a base connected to a node between the first resistor and the second resistor;
a collector connected to the emitter of the PNP BJT; and
an emitter being grounded;
each electric switch of the light driver circuit is an NPN BJT having:
a base connected to the light output pin of the micro controller;
a collector connected to the cathode of the illumination unit; and
an emitter being grounded;
the speaker has:
a power pin connected to the collector of the PNP BJT; and
a signal input pin; and
the sound driver is an NPN BJT having:
a base connected to the sound output pin of the micro controller;
a collector connected to the signal input pin of the speaker; and
an emitter being grounded.

8. The decoration lamp as claimed in claim 7, wherein
the light-controlled circuit has:
a photoresistor;
a resistor;
a first PNP BJT having a base being grounded through the photoresister; and
a second PNP BJT having a collector connected to the voice-light input pin of the micro controller and being grounded through the resistor; and
the voice-controlled circuit has:
an acoustic resistor;
a first NPN BJT having a base being grounded through the acoustic resistor;
a PNP BJT having a collector connected to the voice-light input pin of the micro controller and being grounded through the resistor of the light-controlled circuit; and
a second NPN BJT connected between the first NPN BJT and the PNP BJT.

9. The decoration lamp as claimed in claim 1, wherein
the decoration body has multiple holes formed on outlines of the patterns and formed through the front surface and the back surface of the decoration body;
the second connector has:
a base having:
a front terminal; and
multiple abutting surfaces; and
a second sheet laterally extending from the front terminal of the base and having:
a front surface pressing on the back surface of the decoration body; and
multiple notches;
the first connector has:
a first sheet having:
the opening; and
a back surface pressing on the front surface of the decoration surface; and
multiple buckles formed on the back surface of the first sheet, passing through the hole of the decoration body and the notches of the second sheet and abutting against the abutting surfaces of the base; and
the illumination unit is mounted on the front terminal of the base of the second connector and is exposed in the opening of the first sheet.

10. The decoration lamp as claimed in claim 1, wherein
the decoration body has multiple holes formed on outlines of the patterns and formed through the front surface and the back surface of the decoration body;

the second connector has:
a base having:
a front terminal;
a bottom terminal;
a space; and
multiple apertures formed between the front terminal and the bottom terminal of the base and communicating with the space of the base; and
a second sheet laterally extending from the front terminal of the base and having a front surface pressing on the back surface of the decoration body;
the first connector has:
a first sheet having:
the opening; and
a back surface pressing on the front surface of the decoration body; and
a tube formed on the back surface of the first sheet, passing through the hole of the decoration body, entering the space of the base of the second connector and having:
a space; and
multiple buckles respectively abutting against the apertures of the base; and
the illumination unit is mounted in the space of the base of the second connector and is exposed in the opening of the first sheet through the space of the tube.

11. The decoration lamp as claimed in claim 10, wherein:
the tube of the first connector has:
an outer surface; and
a positioning rib formed on the outer surface of the tube;
the base of the second connector has a positioning groove corresponding to the positioning rib and extending from the front terminal to the bottom terminal of the base of the second connector.

12. The decoration lamp as claimed in claim 11, wherein:
the first sheet has a first engaging portion formed on the back surface of the first sheet;
the second sheet has a second engaging portion formed on the front surface of the second sheet and matching the first engaging portion.

13. The decoration lamp as claimed in claim 1, wherein:
the decoration body has multiple holes formed on outlines of the patterns and formed through the front surface and the back surface of the decoration body;
the first connector has:
a box having:
the opening; and
a back surface pressing on the front surface of the decoration body; and
a first engagement pillar formed on the back surface of the box, passing through the hole of the decoration body and having an outer engagement portion and an inner engagement portion;
the second connector has:
a bottom piece having a front surface; and
a second engagement pillar formed on the front surface of the bottom piece and having an inner engagement portion engaging with the inner engagement portion of the first engagement pillar;
the fixture has a ring mounting around the first engagement pillar and the second engagement pillar and having:
a front terminal;
an inner surface;
an abutting portion formed forward on the front terminal of the ring and pressing on the back surface of the decoration body; and
a locking protrusion formed on the inner surface of the ring and engaged with the outer engagement portion of the first engagement pillar; and
the illumination unit is mounted in the opening of the box and has:
a substrate having a front surface; and
an LED die mounted on the front surface of the substrate.

14. The decoration lamp as claimed in claim 1, wherein:
the decoration body has multiple holes formed on outlines of the patterns and formed through the front surface and the back surface of the decoration body;
the second connector has:
a front surface pressing on the back surface of the decoration body;
two wire grooves formed in the front surface of the second connector; and
two apertures formed through the second connector;
the first connector has:
a first sheet having:
the opening;
a back surface pressing on the front surface of the decoration surface; and
two wire grooves formed in the back surface of the first sheet and corresponding to the wire grooves of the second connector; and
multiple buckles formed on the back surface of the first sheet, passing through the hole of the decoration body and engaging the apertures of the second connector;
the illumination unit is mounted on the front surface of the second connector and is exposed in the opening of the first sheet through the hole of the decoration body.

15. The decoration lamp as claimed in claim 1, wherein the sound signals are pulse width modulation signals.

16. The decoration lamp as claimed in claim 1, wherein the decoration body and the translucent cover are flexible fabrics.

17. The decoration lamp as claimed in claim 1, wherein the patterns are face patterns.

* * * * *